US006116525A

United States Patent [19]

Grimes

[11] Patent Number: 6,116,525

[45] Date of Patent: Sep. 12, 2000

[54] HYDRANT DIFFUSER

[76] Inventor: Paul David Grimes, 6741 Douglas Dr. North, Brooklyn Park, Minn. 55429

[21] Appl. No.: 09/263,533

[22] Filed: Mar. 5, 1999

[51] Int. Cl.[7] ..... B05B 15/08; A01G 25/09; E01C 19/16; E01H 11/00

[52] U.S. Cl. ..... 239/587.5; 239/172

[58] Field of Search ..... 239/198, 499, 239/279, 289, 172, 587.5

[56] References Cited

U.S. PATENT DOCUMENTS

| | | | |
|---|---|---|---|
| 4,047,668 | 9/1977 | DeWeese et al. | 239/500 |
| 4,475,691 | 10/1984 | Hintz | 239/587.5 |

OTHER PUBLICATIONS

Joseph G. Pollard Co., Inc., Truck Mounted Komodo Dragon, Oct. 1998.

Joseph G. Pollard, Co., Inc., Pollard Truck Mounted Diffuser, Oct. 1998.

*Primary Examiner*—Andres Kashnikow

*Assistant Examiner*—Davis Hwu

[57] ABSTRACT

An improved hydrant diffuser, comprising a housing or box with one open end, slows and directs the flow of water from a hydrant when the hydrant has been opened to flush a water line. The diffuser can be mounted on any work truck or other vehicle having a class 3 trailer hitch receiver. A hose may be coupled to a fire hydrant to carry water to the diffuser. The other end of the hose is non-releasably attached to a 90-degree elbow which can be coupled to a flange bolted to the top of the diffuser box. The diffuser mounting to the truck includes means that allow the box outlet to be pointed straight back from the truck or in selected positions up to 90 degrees either to the right or left. A debris screen across the outlet end stops any rocks or other solid objects in the water stream.

4 Claims, 1 Drawing Sheet

Fig. 1.
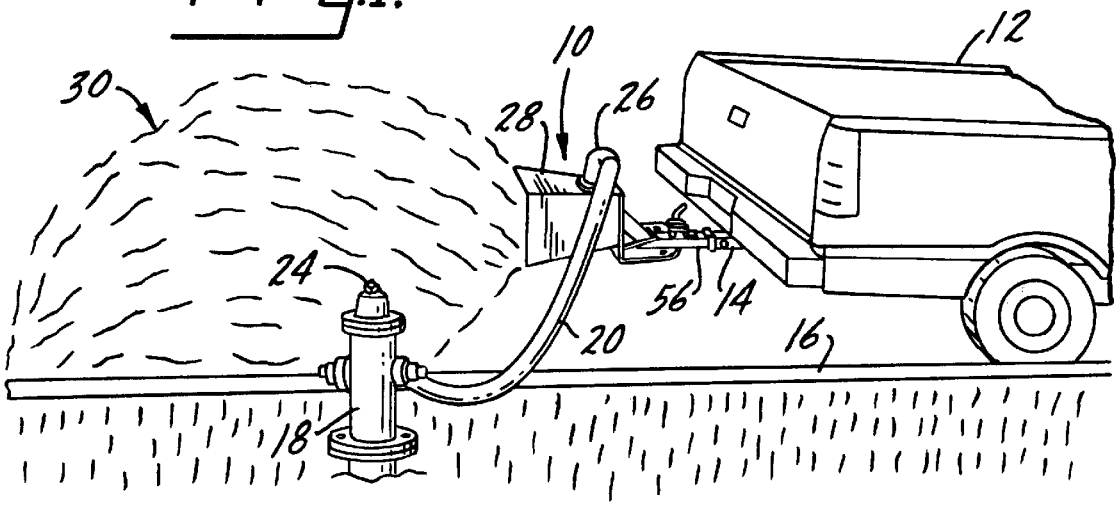
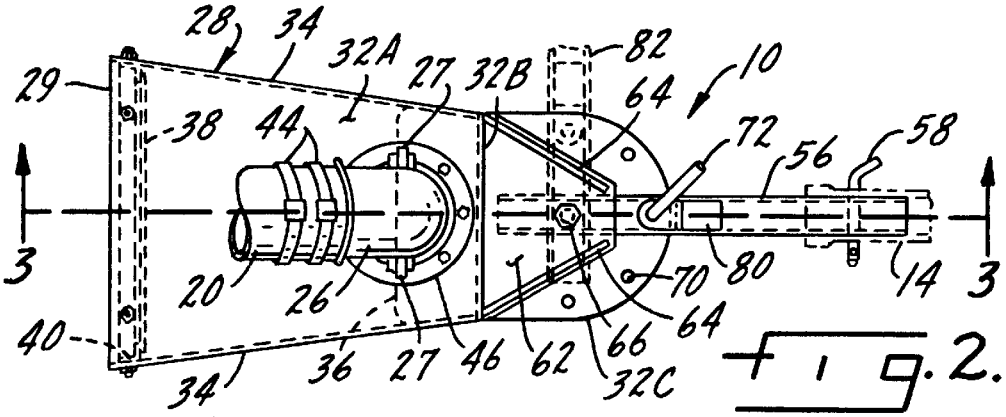
Fig. 2.
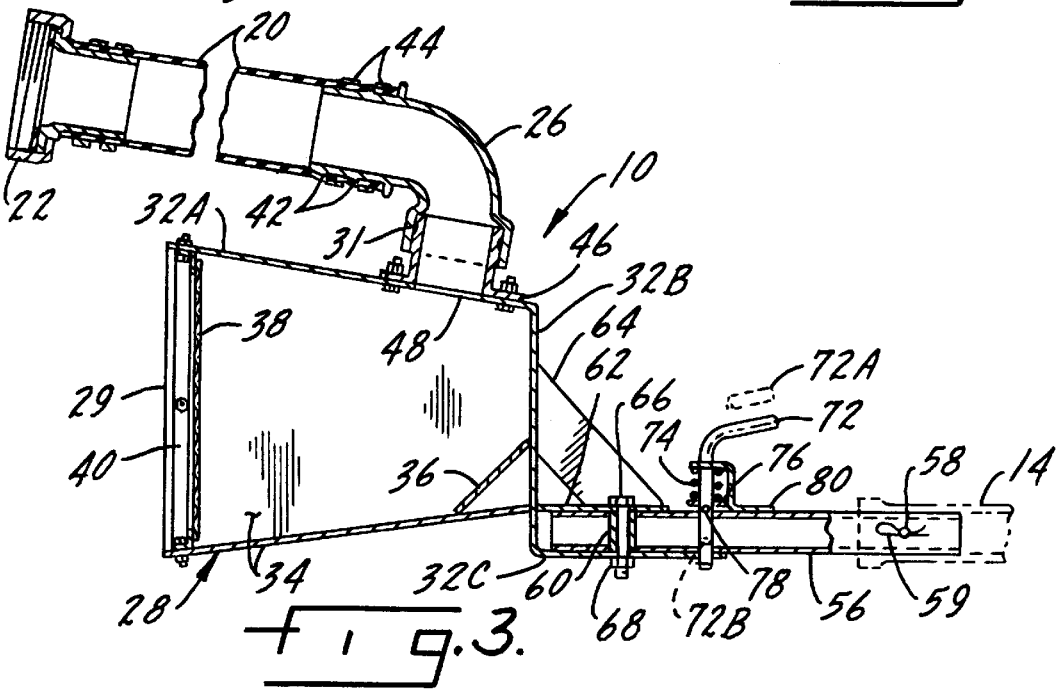
Fig. 3.

HYDRANT DIFFUSER

BACKGROUND OF THE INVENTION

City and suburban water systems have an extensive network of main and branch pipe lines, and there are fire hydrants located at intervals along them. It is good practice to flush these lines periodically to remove accumulated sediments for public health reasons and to exercise the hydrant valves to insure proper working order. This requires opening each fire hydrant in turn and allowing it to flow wide open to flush the lines with high velocity flow until the water runs clear.

An uncontrolled stream of water thrown by a fire hydrant has so much force it can tear up boulevard turf and break or strip nearby shrubs that it may hit. If the direction of discharge cannot be controlled it is possible to cause damage to nearby driveways and low lying basements. Occasionally small rocks amd other solid objects find their way into water mains, especially in new construction areas, and when thrown by a discharging hydrant they can strike cars or people and cause property damage or personal injury.

One response to the above problems has been to connect a short length of fire hose to the hydrant and run it to a street gutter nearby. However, the water blasting out of the hose may kick up loose pebbles or pavement in the gutter, and the reaction force of the water flow makes the free end of the hose difficult and possibly hazardous to control.

Devices are available to reduce the force of the hydrant discharge. U.S. Pat. Nos. 4,047,668 and 4,343,435 disclose diffusers which can be screwed directly onto a hydrant outlet. These direct the water flow straight into a diverging nozzle which contains diffusing elements and has a relatively large outlet area. These serve to slow the velocity of the water flow and thus reduce its force. However, they have little or no provision for controlling the direction of the discharge, and they drop the water on the ground adjacent to the hydrant, so it may wash over the boulevard or private property.

Other diffusers are available which are mounted on a pickup truck or other work vehicle. The truck can be parked in the street near a hydrant and the diffuser can be connected to the hydrant by a hose. These diffuse the water and discharge it into the street gutter, but they provide no selection as to the direction of the discharge, so it may strike a car parked along the curb.

SUMMARY OF THE INVENTION

The present invention is a hydrant diffuser that effectively solves the above described problems found in using prior art equipment. It is a rugged housing or box with walls which may run parallel or may diverge to a relatively large area open outlet end. There is a water inlet hole in the top of the box near the end away from the outlet. There are convenient means for mounting the diffuser on any pickup or other work truck having a class 3 trailer hitch receiver. A length of hose has conventional end fittings; a swivel hydrant coupler on one end and a 90-degree cam look elbow on the other end. This elbow couples with a mating grooved flange bolted to the top of the box over the inlet hole. The elbow can be turned any direction as needed to align the hose toward a hydrant and then secured to the flange by operating two levers with integral cams on the elbow.

Bringing the water stream into the top of the box causes it to shoot down and strike the bottom of the box, thus losing much of its energy, then change direction to flow out the large outlet end. This effectively slows and disperses the water so it flows out in a broad, non-damaging stream. It also slows the velocity of any small rocks or other solid debris carried by the water. A debris screen across the outlet end may be used if desired to completely stop such solid objects.

The means for mounting the diffuser box on a truck includes means for conveniently setting the box to point its outlet straight back from the truck or in selected positions up to 90 degrees to either the right or left. This feature allows the crew to direct the stream of water in the best direction to avoid landscape damage and interference with vehicle traffic or pedestrians.

BRIEF DESCRIPTION OF THE DRAWINGS

FIG. 1 is a perspective view showing the improved hydrant diffuser in use. It is shown mounted on a pickup truck and connected by hose to a fire hydrant.

FIG. 2 is a top view of the improved hydrant diffuser with the hydrant coupling and part of the hose omitted.

FIG. 3 is a sectional view taken on line 3—3 of FIG. 2.

DESCRIPTION OF THE PREFERRED EMBODIMENT

Referring to the drawings, the improved fire hydrant diffuser which is the subject of the present invention is indicated generally by the numeral 10. FIG. 1 shows it in use. There it is shown mounted on a pickup truck 12 by means of a class 3 trailer hitch receiver 14 with which the truck is equipped. The truck may be parked along a street curb 16 near a fire hydrant 18 which is to be flushed. A hose 20, which is considered a part of the diffuser, connects it to the hydrant by means of a conventional fire hose-hydrant coupling, shown at 22 in FIG. 3. This connection is usually made to the pumper nozzle of the hydrant, and the pumper nozzle normally faces toward the street so does not show in FIG. 1. After this connection is made the hydrant is opened by operating hydrant valve control 24, allowing water to flow through the hose and through an inlet elbow 26 into the housing 28 of the diffuser. There, as described earlier, the water velocity is reduced and the stream is dispersed, exiting the housing in a turbulent plume of water 30 as shown in FIG. 1 through the outlet end 29 of the housing.

The diffuser housing 28 may be formed of sheet steel. As seen in FIGS. 2 and 3, one piece of steel forms the top of the housing 32A, the closed end of the housing 32B and the lower pivot plate 32C for attaching the diffuser to the truck. This attachment will be described later. A second piece of steel 34 forms the bottom and both sides of the housing. Parts 32 and 34 are joined by continuous bead welding wherever they meet. A plate 36 reinforces the bottom of the housing in the vicinity where it is struck by the incoming water blast from inlet elbow 26. The lower corners of plate 36 are clipped to provide drainage for any water which may get behind it. In the preferred embodiment as shown the housing diverges from a 10-inch square at its closed end 32B to a 15-inch square at its open or outlet end 29. This gives an adequate outlet area for handling the output of a hydrant pumper nozzle, and saves on material and weight. However, a rectangular housing with parallel sides could also be used, providing it had a comparable outlet area.

If desired, a debris screen 38 may be provided to cover the open end of housing 28. As shown, screen 38 is made of flattened expanded sheet steel and is welded to a frame which is made of four formed angles 40. This assembly is bolted into housing 28 near its open end.

Flange 46 is located over the inlet hole 48 in the top 32A of the diffuser housing 28 near the end away from the outlet, and is bolted to the housing top. It has a groove 31 around it which cooperates with a pair of lever operated locking cams 27 on elbow 26 to secure the elbow to the flange.

Elbow 26 is a hollow 90 degree elbow having a circular cross section. At its inlet end it has barbs or ridges 42 on its O.D. to grip hose 20, which is slid over the barbs. One or more hose clamps 44 are placed around the hose and securely tightened to hold it in connection with the elbow. For maximum security these may be a commercially available non-releasable type which are tightened using special equipment at a factory or maintenance shop and cannot be removed except by destroying them. Similar hose clamps may also be used to secure the other end of hose 20 to hydrant coupler 22, or these may be a conventional reusable type. The elbow 26 and flange 46 are commercially available for cam lock coupling systems. A preferred design of elbow is available which has automatic locking latches to positively hold the levers in engaged position so they can't vibrate loose in service.

As stated earlier, the improved hydrant diffuser can be attached to any vehicle equipped with a class 3 trailer hitch receiver, indicated as 14 in FIGS. 1, 2 and 3. A 2-inch square tube 56 fits into the receiver 14 and is secured by a conventional hitch pin 58 and hairpin cotter 59. There is a hole near the opposite end of the square tube which is a clearance fit for steel bushing 60. This bushing is one inch O.D., 2.06 inches long, and its I.D. is a clearance fit for a ⅝ inch diameter bolt 66.

Upper pivot plate 62 is welded to the closed end 32B of housing 28 and is reinforced by two gussets 64. The spacing between upper pivot plate 62 and lower pivot plate 32C is 2.06 inches. There are aligned holes in the two pivot plates which are a clearance diameter for bolt 66. This bolt passes through upper pivot plate 62, bushing 60 and lower pivot plate 32C and is secured with nut 68, which may be a nylon collar lock nut.

The 2-inch square tube 56 will have a little clearance between the pivot plates, so the diffuser housing may be pivoted around bushing 60 to direct the water outflow anywhere up to 90 degrees right or left from a position pointing straight back from the truck. A 90-degree position is shown in dotted lines 82 in FIG. 2.

A latch pin 72 is provided to lock the diffuser housing in any one of several selected positions. There are 5 holes 70 in lower pivot plate 32C, though this could be another number. These holes are a clearance diameter for pin 72. They are located angularly to evenly divide a 180-degree arc and on a given radius from the hole for pivot bolt 66. There are two aligned holes through square tube 56 which also are a clearance diameter for pin 72 and are located so pin 72 can be dropped through them and through any one of the holes 70 in the lower pivot plate to lock the diffuser housing in a selected position.

A bracket 80 has a clearance hole for pin 72 and is welded to square tube 56 in such a position that its hole lines up with those in the square tube, as shown in FIG. 3. Pin 72 has a cross hole 78 for a cotter pin, not shown. A compression coil spring 74 and a flat washer 76 are assembled as shown in FIG. 3 and retained by the cotter pin in hole 78. The spring as installed is partially compressed, so it will hold pin 72 down to pass through the square tube and lower pivot plate, pinning them together. However, pin 72 may be pulled up to position 72A by compressing spring 74 to its solid height. When pin 72 is thus held up its lower end 72B clears the lower pivot plate so the diffuser housing may be freely pivoted to a different position.

A preferred embodiment of the improved hydrant diffuser has been described, but many variations are possible. For example, other materials such as aluminum or plastic could be used in place of steel. These and other variations would still be within the scope of the invention.

I claim:

1. A hydrant diffuser comprising a housing having an inlet and an outlet for the flow of water;

means for mounting said housing on a truck or other vehicle;

means for selectively pointing said outlet in a horizontal plane either straight back from the vehicle or (at an angle) in any one of a plurality of angular positions up to 90 degrees to either the right or left from the straight back position.

2. The hydrant diffuser of claim 1 in which means are provided for positively securing said outlet in (a) any one of said selected positions.

3. The hydrant diffuser of claim 1, an inlet flange attached to the housing in line with the housing inlet, a 90-degree hollow elbow having a first end and a second end, the first end being attachable to the inlet flange, a hose having a first end and a second end, the first hose end being attached to the second end of the elbow and the second hose end being attached to a coupling means whereby the hose may be connected to a hydrant, thereby connecting the diffuser to a hydrant, and in which the first end of the hose which is attached to the second end of the elbow is secured to the elbow with one or more non-releasable hose clamps.

4. The hydrant diffuser of claim 3, in which the elbow is equipped with levers and cams for securing its first end to the inlet flange, and locking latches to secure the levers in their engaged positions.

* * * * *